US006106947A

United States Patent [19]

Smith

[11] Patent Number: 6,106,947

[45] Date of Patent: Aug. 22, 2000

[54] PROTECTIVE WARP KNIT FABRIC

[75] Inventor: Allan W. Smith, Gaffney, S.C.

[73] Assignee: Milliken & Company, Spartanburg, S.C.

[21] Appl. No.: 09/084,645

[22] Filed: May 26, 1998

[51] Int. Cl.[7] ..... B32B 9/00

[52] U.S. Cl. ..... 428/409; 442/132; 442/133; 427/160; 8/115.51

[58] Field of Search ..... 442/132, 133; 428/409; 427/160; 8/115.51

[56] References Cited

U.S. PATENT DOCUMENTS

| | | | |
|---|---|---|---|
| 2,399,392 | 4/1946 | Sandinoff | 66/193 |
| 3,308,827 | 3/1967 | Gross | 128/290 |
| 3,389,583 | 6/1968 | Duhl | 66/193 |
| 4,067,209 | 1/1978 | Kucera et al. | 66/195 |
| 4,854,135 | 8/1989 | Petracek et al. | 66/190 |
| 5,503,917 | 4/1996 | Hughs | 428/229 |
| 5,637,348 | 6/1997 | Thompson et al. | 427/160 |

*Primary Examiner*—Richard Weisberger
*Attorney, Agent, or Firm*—Terry T. Moyer; Earle R. Marden

[57] ABSTRACT

A three-bar warp knit, weft inserted fabric which provides at least 70% blockage of ultra-violet rays and has a cover factor of less than 50%. The weft inserted yarn is a bouclé yarn which in the warp knit construction provides the above described characteristics.

15 Claims, 2 Drawing Sheets

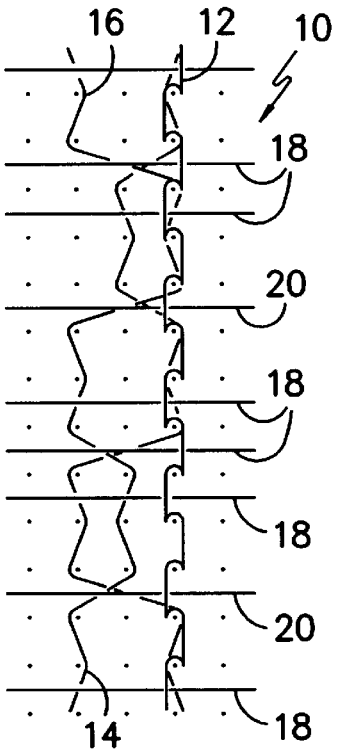
FIG. —1—
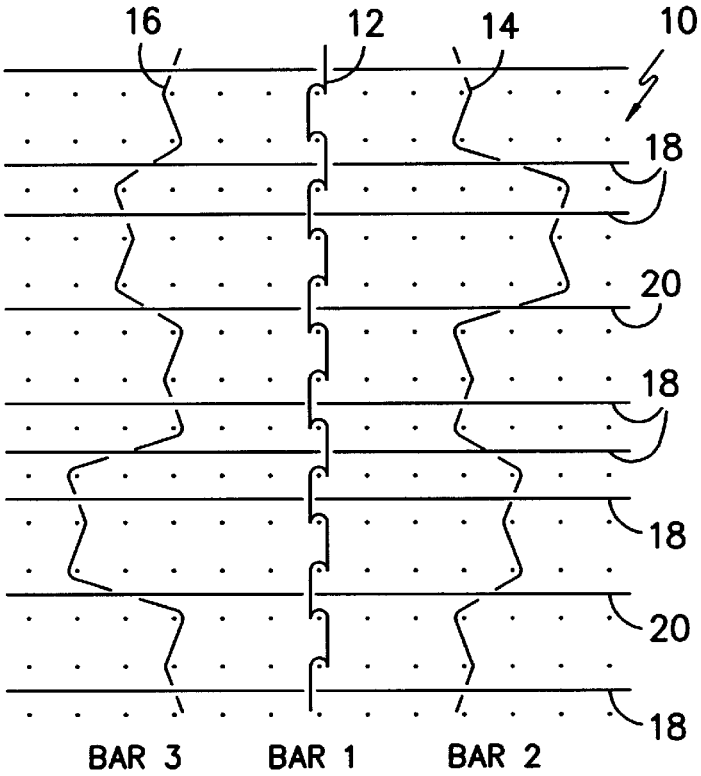
FIG. —2—
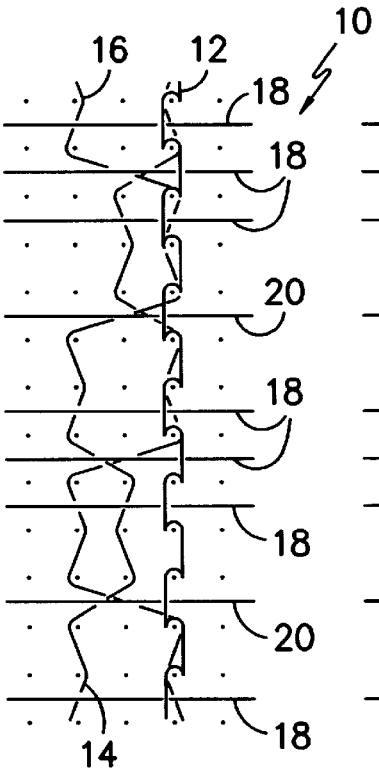
FIG. —3—
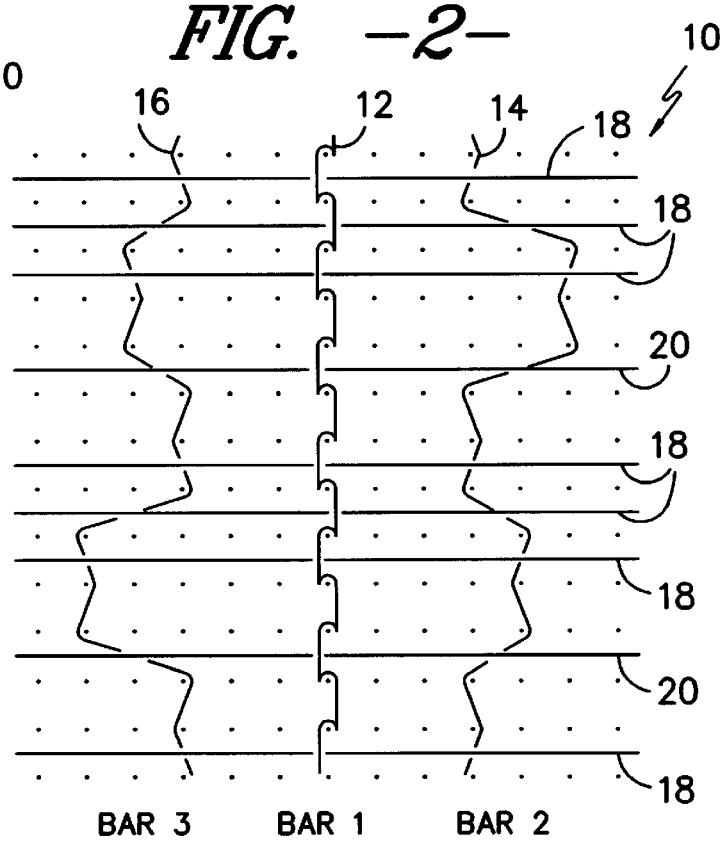
FIG. —4—

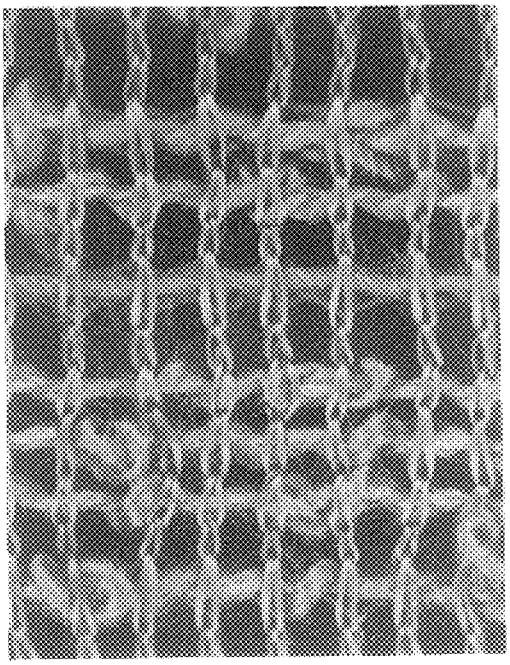
FIG. —5—
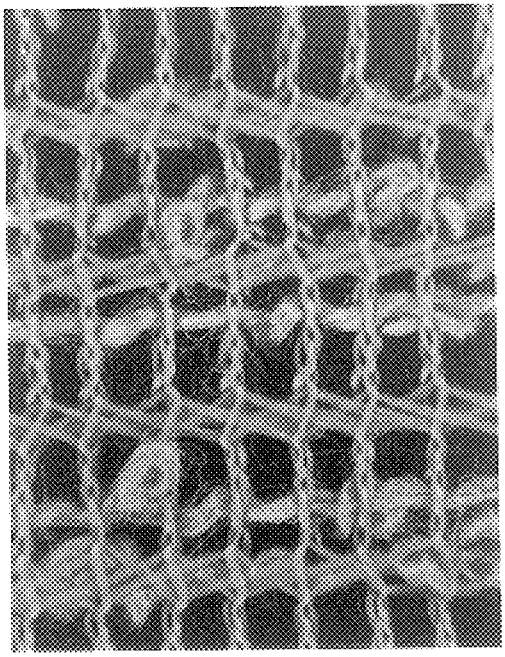
FIG. —6—

PROTECTIVE WARP KNIT FABRIC

This invention relates generally to fabric used to protect humans and/or equipment from the harmful effects of ultra-violet rays generated by the sun which cause deterioration effects.

In the past fabrics used to block ultra-violet rays from the sun did not provide visibility or ventilation since it was necessary to have a high percentage cover factor in order to block a high percentage of the ultra-violet rays. Generally the prior art fabrics were woven and had a cover factor in excess of 75% and were not particularly useful for protective clothing, parasols or other uses where it is desired to have ventilation and see-through characteristics, as well as high ultra-violet ray protection.

It is therefore an object of the invention to provide a fabric which has a high percentage blocking effect of ultra-violet rays and low coverage to allow see through as well as good ventilation.

Other objects and advantages of the new and novel fabric will become clearly apparent as the specification proceeds to describe the invention with reference to the accompanying drawings in which:

FIGS. 1 and 2 are point diagrams illustrating the new and novel three bar warp knit fabric with weft insertion;

FIGS. 3 and 4, like FIGS. 1 and 2, are point diagrams showing a modification; and FIGS. 5 and 6 are photomicrographs (9.4X) respectfully, of the front and back of the fabric illustrated by the point diagrams of FIGS. 1 and 2.

Looking now to the drawings FIGS. 1 and 2 represent the point diagram of the warp knit, weft inserted fabric 10 of FIGS. 5 and 6. The fabric 10 is a three bar warp knit, weft inserted fabric with bar 1 knitting a chain stitch 12 of 40 denier, 27 filament polyester yarn with a stitch pattern of 1-0/0-1. Bars 2 and 3 are laying in the warp yarns 14 and 16 of 40 denier. 27 filament polyester in opposite directions with bar 2 employing a stitch pattern of 3-3/2-2/3-3/1-1/2-2/1-1/3-3/2-2/3-3/0-0/1-0/0-0/ and bar 3 employing a stitch pattern of 0-0/1-1/0-0/3-3/2-2/3-3/0-0/1-1/0-0/2-2/1-1/2-2 to provide dimensional stability.

As previously discussed it is desired to provide high blockage of ultra-violet rays but maintain low coverage for ventilation and see-through characteristics. To this end weft yarns 18 and 20 are inserted in standard manner in the fill direction of the knitting machine. Weft yarn 18 is a 760 denier, bouclé yarn consisting of a 3-ply core yarn wrapped with a 20's count spun yarn and 40 denier filament yarn which, by definition, is a loopy yarn while weft yarn 20 is a 266 denier, spun polyester staple yarn. As shown in the preferred embodiment, the weft yarns are inserted in the course or fill direction initially with one weft yarn 20 inserted, skip one course, insert three weft yarns 18 each in successive courses thereafter, skip one course and insert one weft yarn 18, skip one course and insert two weft yarns 18 in successive courses and then skip one course and repeat the pattern. As shown, the three weft yarns and two weft yarns are yarn 18 of bouclé polyester yarn while the single inserted yarns are the spun poly weft yarns 20. The use of the spun poly yarns is preferred but all of the weft yarns, if desired, could be multifilament polyester bouclé yarns, if desired.

Currently the majority of the ultra-violet blocking fabrics sold today are woven fabrics which provided the following data upon testing in standard conditions against different colored samples of the disclosed warp knit fabric.

COMPARATIVE FABRIC TEST RESULTS

| | % BLOCKING | | | |
|---|---|---|---|---|
| SAMPLE | UVA | UVB | AVERAGE | COVERAGE |
| 1 | 30 | 41 | 36 | 60% |
| | 43 | 39 | 41 | |
| 2 | 52 | 60 | 56 | 60% |
| | 48 | 40 | 44 | |
| 3 | 61 | 66 | 64 | 60% |
| | 58 | 62 | 60 | |
| 4 | 48 | 50 | 49 | 48% |
| 5 | 76 | 76 | 76 | 49% |
| 6 | 77 | 78 | 78 | 49% |
| 7 | 70 | 76 | 73% | 49% |

From the above data it can be seen that the commercially available woven ultra-violet ray blocking fabric 1–4 when compared to the different colored warp knit fabrics 4–7 as disclosed had a substantially higher coverage of about 60% as compared to 50% for the disclosed fabric while the percent blocking of UV was considerably less. The disclosed fabric has an ultra-violet blocking average in excess of 70 while the coverage of 50% provides better see-through and ventilation.

FIGS. 3 and 4 indicate a stitch pattern that is different from that of FIGS. 1, 2, 5, and 6 in that the weft yarns are laid in a pattern of 1, 3, 1 and 3 rather than 1, 3, 1 and 2 of the preferred fabric. Also, as mentioned the weft inserted yarns can be all multifilament polyester bouclé yarns or any desired combination of such yarns with spun or textured polyester yarns so long as the knit fabric provides the desired UV blockage with the lower coverage to provide see-through and good ventilation characteristics.

As herein described, the new and improved ultra-violet bouclé fabric is a weft insertion knit so designed because it is the most effective way of a knitting machine to handle the"bouclé" yarn. These yarns are referred to as the fill. The warp yarns are a multifilament, small denier (40), polyester. The construction consists of 3 bars of these yarns; 1 is a chain stitch to tie in the fill yarns, bar 2 and 3 are laid in opposing direction to give the fabric extreme dimensional stability. This dimensional stability allows the fabric to be strong enough to be dyed in conventional methods and to be used as a fabric strong enough to meet the standards required by garments. The smaller size of the yarns and their pattern allows the fabric to remain as open as possible. This fabric provides more efficient ultra-violet ray blockage with the disadvantage of high coverage which lowers the see-through and ventilation characteristics found in such fabrics.

The above-described embodiments are given for the purpose of illustration only. Improvements and modification may be made to those embodiments without departing from the scope of the invention.

I claim:

1. A warp knit ultra-violet ray protective fabric comprising: a warp knit fabric and a plurality of weft yarns inserted in the fill direction of said fabric to provide a blockage of ultra-violet rays through said fabric of at least 70% and a coverage factor of less than 50%.

2. The fabric of claim 1 wherein a plurality of said weft yarns are bouclé yarns.

3. The fabric of claim 2 wherein said bouclé yarns are polyester.

4. The fabric of claim 3 wherein said bouclé yarns are inserted in groups of two or three and are separated by a spun yarn.

5. The fabric of claim 3 wherein said bouclé yarns are inserted in groups of three and are separated by a spun yarn.

6. The fabric of claim 5 wherein said spun yarn is a polyester.

7. A three bar warp knit, weft inserted fabric for use as an ultra-violet ray protective fabric comprising: a warp knit fabric having a plurality of weft yarns inserted in the fill direction to provide at least 70% blockage of ultra-violet rays with a coverage below 50% to provide ventilation therethrough for comfort.

8. The fabric of claim 7 wherein a plurality of said weft yarns are bouclé yarns.

9. The fabric of claim 8 wherein the three bars provide two warp lay-in yarns and a chain stitch in the wale direction of the warp which is repeated across the course direction of the fabric to provide dimensional stability to the fabric.

10. The fabric of claim 9 wherein said bouclé yarns are inserted in groups of two or three and are separated by a spun yarn.

11. The fabric of claim 10 wherein said bouclé yarns are inserted in groups of three and are separated by a spun yarn.

12. The fabric of claim 11 wherein said warp lay-in yarns are laid in with a stitch pattern of 3-3/2-2/3-3/1-1/2-2/1-1/3-3/2-2/3-3/0-0/1-1/0-0 and 0-0/1-1/0-0/3-3/2-2/3-3/0-0/1-1/0-0/2-2/1-1/2-2.

13. The fabric of claim 12 wherein substantially all of the weft inserted yarns are polyester.

14. The fabric of claim 13 wherein the warp yarns are 40 denier polyester.

15. The fabric of claim 14 wherein the weft yarns are substantially larger in diameter than said warp yarns.

* * * * *